US009707789B2

(12) United States Patent
Zhou et al.

(10) Patent No.: US 9,707,789 B2
(45) Date of Patent: Jul. 18, 2017

(54) PRINTABLE RECORDING MEDIA

(71) Applicant: Hewlett-Packard Development Company, L.P., Houston, TX (US)

(72) Inventors: Xiaoqi Zhou, San Diego, CA (US); Xulong Fu, San Diego, CA (US); Francois K. Pirayesh, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/898,468

(22) PCT Filed: Sep. 11, 2013

(86) PCT No.: PCT/US2013/059133
§ 371 (c)(1),
(2) Date: Dec. 14, 2015

(87) PCT Pub. No.: WO2015/038108
PCT Pub. Date: Mar. 19, 2015

(65) Prior Publication Data

US 2016/0144644 A1 May 26, 2016

(51) Int. Cl.
*B41M 5/50* (2006.01)
*B41M 7/00* (2006.01)
(Continued)

(52) U.S. Cl.
CPC ..... *B41M 5/502* (2013.01); *B41M 5/0011* (2013.01); *B41M 5/504* (2013.01);
(Continued)

(58) Field of Classification Search
CPC . B41M 5/5254; B41M 5/5218; B41M 7/0027
See application file for complete search history.

(56) References Cited

U.S. PATENT DOCUMENTS 6,291,127 B1 9/2001 Dagan et al.
7,312,896 B2 12/2007 Shibahara et al.
(Continued)

FOREIGN PATENT DOCUMENTS

CN 1178274 4/1998
CN 1488519 4/2004
(Continued)

OTHER PUBLICATIONS

International Search Report and Written Opinion for International Application No. PCT/US2013/059133 dated Jun. 24, 2014, 11 pages.
(Continued)

*Primary Examiner* — Betelhem Shewareged
(74) *Attorney, Agent, or Firm* — HP Inc. Patent Department

(57) ABSTRACT

A printable recording media including a supporting base substrate having, on both supporting sides, pre-coating layers containing inorganic pigments and polymeric binders, and having, at least, one top ink-receiving layer, that includes inorganic pigments and water-dispersible polymeric binders having a glass transition temperature within the range of about 0° C. to about 35° C., over the pre-coating layer. Also described herein is a method for making the printable recording media, a method for forming printed articles and the obtained printed articles.

16 Claims, 2 Drawing Sheets

(51) Int. Cl.
*B41M 5/00* (2006.01)
*B41M 5/52* (2006.01)

(52) U.S. Cl.
CPC ..... *B41M 5/506* (2013.01); *B41M 7/0027* (2013.01); *B41M 5/5218* (2013.01); *B41M 5/5254* (2013.01); *B41M 2205/34* (2013.01)

(56) References Cited

U.S. PATENT DOCUMENTS

| | | | |
|---|---|---|---|
| 7,315,718 | B2 | 1/2008 | Sisler et al. |
| 7,776,435 | B2 | 8/2010 | Omote et al. |
| 2003/0228428 | A1 | 12/2003 | Kim et al. |
| 2005/0249922 | A1 | 11/2005 | Zhou et al. |
| 2007/0218254 | A1 | 9/2007 | Zhou et al. |
| 2010/0260939 | A1 | 10/2010 | Foley |
| 2011/0200817 | A1 | 8/2011 | Duckworth |
| 2013/0201251 | A1 | 8/2013 | Pal et al. |
| 2014/0044897 | A1 * | 2/2014 | Zhou ..... B41M 5/5254 428/32.22 |

FOREIGN PATENT DOCUMENTS

| | | | | |
|---|---|---|---|---|
| CN | 101090831 | | 12/2007 | |
| JP | H10171145 | | 6/1998 | |
| WO | WO 2012/057785 | A1 * | 5/2012 | ..... B41M 5/50 |
| WO | WO2012/087334 | | 6/2012 | |
| WO | WO 2012/148404 | | 11/2012 | |
| WO | WO 2013/015767 | A1 * | 1/2013 | ..... B41M 5/50 |

OTHER PUBLICATIONS

Rimai. D.S., et al., "The Role of Adhesion in Electrophotographic Digital Printing", Journal of Adhesion Science and Technology, vol. 24, Issue 3, 2010, 583-617.

* cited by examiner

PRINTABLE RECORDING MEDIA

BACKGROUND

Today, images are often captured with a digital camera, transferred electronically to a computer with a printer, or directly to a printer, and then produced by the printer in a hardcopy form. Color inkjet printing and/or laser-jet printing are, among other, often used for printing such high quality photographs. However, in recent years, consumers and businesses have turned to electrophotographic printing systems to produce such digital images on a variety of substrates. Electrophotographic printing systems are using liquid or dry toner electrophotographic ink as ink composition.

It has rapidly become apparent that the image quality of printed images using such printing technology is strongly dependent on the construction of the recording media used. Consequently, improved recording media, often specifically designed, have been developed for use in electrophotographic printing devices. However, while many developments have been made, it has often created challenges to find printable recording media which can be effectively used with electrophotographic printing techniques and which have good image quality as well as good durability. Accordingly, investigations continue into developing such media substrates.

BRIEF DESCRIPTION OF THE DRAWINGS

The drawings illustrate various embodiments of the present recording media and are part of the specification.

DETAILED DESCRIPTION

Figure 1:
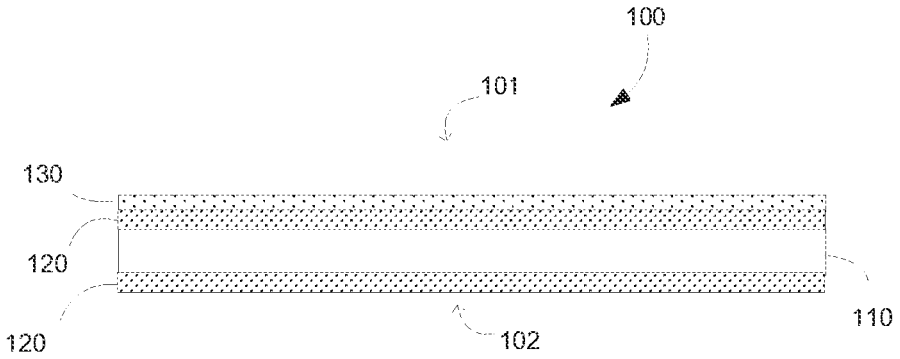
FIGS. 1 and 2 are cross-sectional views of the printable recording media according to embodiments of the present disclosure.

Before particular embodiments of the present disclosure are disclosed and described, it is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percent are by weight (wt %) unless otherwise indicated. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

The present disclosure relates to a printable recording media including a supporting base substrate and having pre-coating layers, containing inorganic pigments and polymeric binders, that are applied to both sides of the supporting base substrate; and having, at least, one top ink-receiving layer, containing inorganic pigments and water-dispersible polymeric binders with a glass transition temperature within the range of about 0° C. to about 35° C., that is applied over said pre-coating layer.

The printable media of the present disclosure is a multilayer composite structure. The word "composite" refers herein to a material made from at least two constituent materials, or layers, that have different physical and/or chemical properties from one another, and wherein these constituent layers remain separate at a molecular level and distinct within the structure of the composite. The printable recording media encompasses image receiving coatings or top ink-receiving layer. As used herein, the terms "image receiving coating" or "top ink-receiving layer" are meant to be understood broadly as any coating which can receive an ink or toner.

In some examples, the printable recording media of the present disclosure is a photographic printing recording media or photo paper recording media, which means herein that the printable recording media is well adapted for photographic printing and that it has the properties and appearances, at least, equal to the properties and appearance of silver halide photo media substrates when image is printed thereon. The printable recording media is thus able to provide advantages such as glossy appearance, surface smoothness and excellent image quality when used to produce photographic printouts. In addition, the printable recording media described herein provides an excellent photobase paper feel. As used herein, the term "photo feel" means that that the printed image feels like a photographic silver halide material when touched.

In some other examples, the printable recording media is an electrophotographic recording media. By electrophotographic recording media, it is meant herein that the media is well adapted for electrophotographic printing processes. The term "electrophotographic printing" is meant to be understood broadly as including any number of methods that use light to produce a change in electrostatic charge distribution to form a photographic image including, but in no way limited to, laser printing. The printable media is thus well-adapted for liquid electrophotographic printing device (i.e. using liquid electrophotographic toner such as, for example, HP Indigo Digital Press 6000 or 6600).

Thus, in yet some other examples, the printable recording media is an electrophotographic photographic recording media. The media can be an electrophotographic photographic recording media for liquid electro-photographic printing (LEP) and can be used in a method of forming photographic printed images. Throughout the various illustrative examples of the present application, the electrophotographic photographic recording media may receive images from printing device such as, for example, an Indigo® WS6000P Digital Printing Press available from Hewlett-Packard Company (Palo Alto, Calif., USA). Without being linked by any theory, it can be said that, with a six color Indigo® digital printing press WS6000P or 6600P, a user is able to produce photo quality prints comparable to silver halide photo prints. Furthermore, with the use of the printable recording media described herein, there will not need of any additional surface treatment (primer layer) and processing to address inadequate ink or toner adhesion and print uniformity issues to the media, as it is often the case with traditional offset type media.

The printable recording media, described herein, is an image-receiving media that shows excellent print image quality. Said recording media yield not only high gloss appearance but, further, provides a solution to keep the gloss stable under the heat, whether the printers are equipped with single or double heated fuser rollers. In some examples, the printable recording media has a non-imaged gloss which is above about 60 to 100% when tested at 75° angle per Tappi test method of T480, or which is above about 25 to 50% when tested at 60° angle.

The printable recording media of the present disclosure has an excellent curl control and does not have any curling issues. Said media is consider to lay flat (i.e. having a curl less than 20 mm) across 15° to 30° and 20% to 80% RH condition while achieves good toner adhesion after printing across different user environment. (Photo papers with a curl that is more than 20 mm might result in poor user experiences). The printable recording media has thus excellent runnability (the runnability refers to the ability of the media to feed and deliver through a copying machine without causing jams).

Therefore, the recording media described herein has a good surface smoothness, has a high gloss appearance, shows excellent image quality and runnability performances when used to produce photographic printouts. In addition, the recording media has a structure which is receptive and which presents excellent absorption and adherence properties to the ink deposed thereon. The printable recording media enables thus electrophotographic photo printing, such as, for examples, Indigo photo printing, without the need of using any primer composition.

Figure 2:
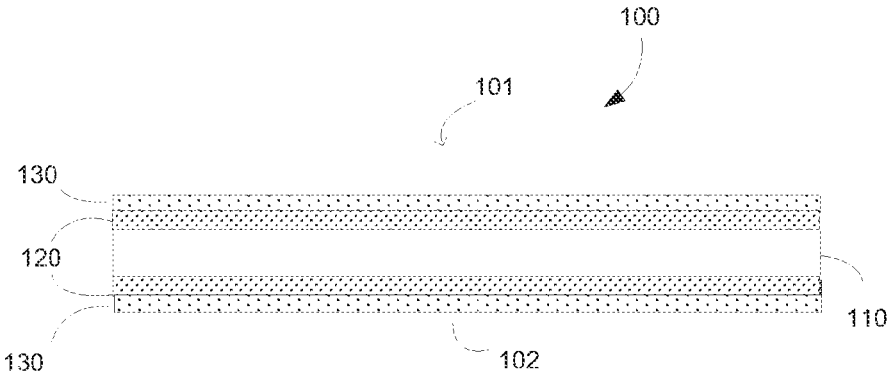
Figure 3:
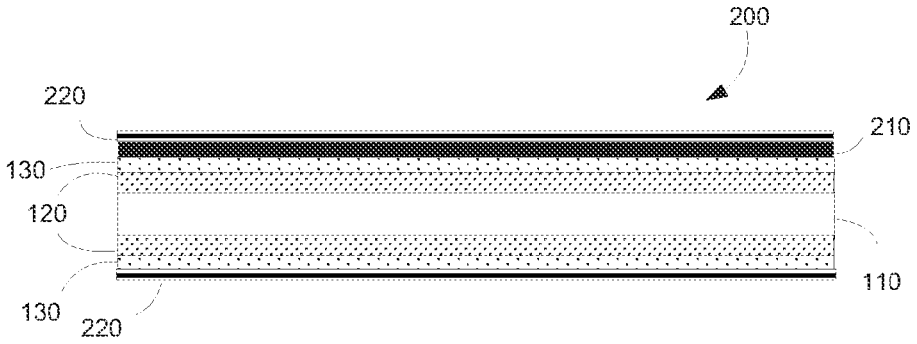
FIG. 3 is a cross-sectional view of the printed article obtained according to embodiments of the present disclosure.
Figure 4:
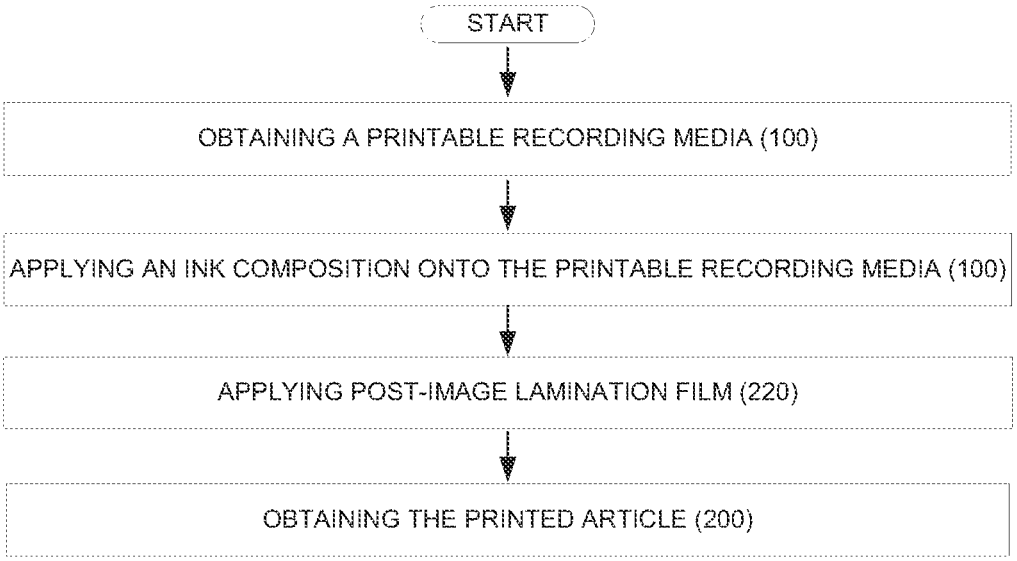
FIG. 4 is a flowchart illustrating the method for producing a printed article according to some embodiments of the present disclosure.

FIG. 1 and FIG. 2 schematically illustrate some embodiments of printable recording media (100). FIG. 3 schematically illustrates some embodiments of a printed article (200). FIG. 4 is a flowchart illustrating the method for producing said printed article (200). As will be appreciated by those skilled in the art, FIG. 1, FIG. 2 and FIG. 3 illustrate the relative positioning of the various layers of the printable media or printed article without necessarily illustrating the relative thicknesses of the various layers. It is to be understood that the thickness of the various layers is exaggerated for illustrative purposes.

In some examples, as shown in FIG. 1 or in FIG. 2, the printable media (100) encompasses a base substrate (110); said base substrate (110) can be a paper base substrate. The base substrate has two surfaces: a first surface, which might be referred to as the "image receiving side", "image surface" or "image side" (101), and a second surface, the opposite surface, which might be referred to as the "back surface" or "backside" (102). Both the image side (101) and the backside (102) of the media might receive, support and protect an image. In some embodiments, as illustrated in FIG. 1, the printable recording media (100) encompasses a supporting substrate (110), above which is applied a pre-coating layer (120) and a top ink-receiving layer (130). As illustrated in FIG. 1, the top ink-receiving layer (130) is applied, only, on one side of the supporting substrate (110). On the other side of the supporting substrate (110) (i.e. backside), only the pre-coating layer (120) is applied. FIG. 2 illustrates some other embodiments of the printable media (100) wherein the printable media includes pre-coating layers (120) and top ink-receiving layers (130) on both sides of the base substrate (110).

FIG. 3 illustrates an example of a printed article (200) according to the present disclosure. The printed article includes a printable media containing a supporting substrate (110) having on both sides pre-coating layers (120) and top ink-receiving layers (130), above which is present a printed image (210). A post-image lamination film (220) is disposed above said printed image (210) as well as on the back side on the printed media (i.e. over the top ink-receiving layer (130)).

Printable Media (100)

Supporting Base Substrate (110)

The printable media (100) contains a supporting substrate (110) that acts as a bottom substrate layer. The print media substrate (i.e., 'substrate') contains a material that serves as a base upon which the ink-receiving layer is applied. The print media substrate provides integrity for the resultant print medium. The supporting base substrate or raw base substrate (110), on which coating compositions are applied, may take the form of a media sheet or a continuous web suitable for use in a printer. The supporting substrate may be a base paper manufactured from cellulose fibers. The base paper may be produced from chemical pulp, mechanical pulp, thermal mechanical pulp and/or the combination of chemical and mechanical pulp. In some instances, when mechanical pulp is added, the total percentage of mechanical pulp is less than 20% of the total raw base weight. The base paper may also include conventional additives such as retention aid, dry or wet strength agent, internal sizing agents and fillers.

The supporting base substrate (110) can be a cellulose base paper. The raw base substrate (110) can be made of any suitable wood or non-wood pulp. Non-limitative examples of suitable pulps include any kind of chemical pulp, mechanical wood pulp, chemically treated ground pulp, CTMP (chemical thermo mechanical pulp), and/or mixtures thereof. Bleached hardwood chemical pulps may make up the main pulp composition. This pulp has shorter fiber structure than soft wood, which contribute to good formation of the finished paper. In some examples, the raw base substrate (110) contains 100% of chemically treated fiber such as bleached hardwood, softwood fiber, non-wood fiber, synthetic fiber, and combinations. In some other examples, the raw base substrate (110) contains 100% of bleached hardwood and, in yet some other examples, the raw base substrate (110) contains from about 50 to about 95% of bleached hardwood and from about 5 to about 50 wt % of softwood.

Fillers may be incorporated into the pulp, for example, to substantially control physical properties of the final coated paper. The filler particles fill in the void spaces of the fiber network and result in a denser, smoother, brighter and opaque sheet. Examples of the fillers include, but are not limited to, ground calcium carbonate, precipitated calcium carbonate, titanium dioxide, kaolin clay, silicates, plastic pigment, alumina trihydrate, magnesium oxide and/or mixtures thereof. In some examples, the supporting base substrate contains fillers in an amount ranging from about 0.2 wt % to about 25 wt % of the raw base, and in some other examples, the amount of filler ranges from about 3 wt % to about 15 wt % of the raw base.

When preparing the paper base stock, internal and surface sizing may be used. This process may improve internal bond strength of the substrate fibers, and may control the resistance of the coated substrate to wetting, penetration, and absorption of aqueous liquids. Internal sizing may be accomplished by adding a sizing agent to the raw base in the wet end. Non-limitative examples of suitable sizing agents include rosin-based sizing agent(s), wax-based sizing agent (s), cellulose-reactive sizing agent(s) and other synthetic sizing agent(s), and/or mixtures. In some examples, the internal sizing agents are Alkyl Ketene Dimer (AKD) or alkenylsuccinic anhydride (ASA). It is to be understood that the type and amount of surface sizing agent(s) may substantially improve moisture resistance and may alter the stiffness of the base paper stock. Surface sizing (i.e. apply sizing agent to the paper surface during papermaking process) may be accomplished by film size press, pond size press and other surface techniques. Included in this wet end processing can be additional functional additives such as but not limited to dispersants, biocides, retention aids, defoamers, dyes, and optical brighteners. The raw base substrate (110) can also be surfaced treated with starch or with starch and latex binder with pigments. The surface sizing agent might result in a coat weight of sizing agent is the range of about 0.2 gsm to about 4 gsm.

In some examples, the raw base substrate has a basis weight of about 80 to about 300 gsm, and, in some other examples, has a basis weight of about 150 to about 220 gsm. The stiffness of the raw base can range from about 200 Gurley stiffness units to about 2000 Gurley stiffness units in the paper machine direction, and can range from about 400 Gurley stiffness units and about 1200 Gurley stiffness units in the paper cross machine direction. In some other examples, the base paper stiffness ranges from about 800 Gurley stiffness units to about 1500 Gurley stiffness units in the paper machine direction, and from about 600 Gurley stiffness units to about 1000 Gurley stiffness units in the paper cross machine direction. A method, such as TAPPI T543 om-94, using a Gurley-type stiffness tester, may be used to determine the stiffness of the paper stock. Without being linked by any theory, it is believed that the surface smoothness of the base stock paper is an important factor in the quality of the paper and photographic images printed thereon. A photographic printing base stock with high smoothness and glossiness can be made at effectively low cost, as long as the pigmented sub layer sheets have a minimum smoothness and glossiness level. The surface smoothness can be in the range of from about 0.3 to about 5.0 μm, as measured by a Parker Print Surface (PPS) microprocessor-controlled instrument that performs high speed, precision measurements of paper surface roughness from Testing Machine Inc. (TMI), DE, USA.

Pre-Coating Layer (120)

The printable recording media (100) encompasses a pre-coating layer (120). Said a pre-coating layer (120) is applied above the supporting base substrate (110) on both sides of the supporting base substrate (110), such as illustrated in FIGS. 1 and 2. In some examples, the pre-coating layer (120) is applied to the raw base (110) with a coat weight of about 2 to about 25 grams/meter$^2$ (gsm) or with a coat weight ranging from about 10 to about 15 gsm. Without being linked by any theory, it is believed that the function of the pre-coating layer (120) is to create a smooth surface to help develop superior gloss. Additionally, the pre-coating layer (120) can promote improved opacity, brightness, and appropriate color hue for the print media.

The pre-coating layer (120) contains at least one inorganic pigment and at least one polymeric binder. In some examples, the inorganic pigment may be prepared in powder or slurry form before being mixed with the binder for coating on the substrate. Examples of inorganic pigments include, but are not limited to, titanium dioxide, hydrated alumina, calcium carbonate, barium sulfate, silica, high brightness alumina silicates, boehmite, pseudo-boehmite, zinc oxide, kaolin clays, and/or their combination. The calcium carbonate may be ground calcium carbonate (GCC) or may be a chemical precipitated calcium carbonate (PCC).

The pre-coating layer (120) may contain from about 40 to about 95 wt % of inorganic pigments by total weight of the layer. Further, with regard to the pigments, the pre-coating layer (120) may include, for example, ground calcium carbonate such as Hydrocarb® 60 available from Omya Inc.; precipitated calcium carbonate such as Opacarb® A40 or Opacarb® 3000 available from Specialty Minerals Inc.; clay such as Miragloss® available from Engelhard Corporation; synthetic clay such as hydrous sodium lithium magnesium silicate, such as, for example, Laponite® available from Southern Clay Products Inc., and titanium dioxide (TiO2) available from, for example, Sigma-Aldrich Co. The particle size of inorganic pigments can range from about 0.2 to about 1.5 micrometer, or, can range from about 0.5 to about 1.0 micrometer.

The pre-coating layer (120) contains at least one polymeric binder. Without being linked by any theory, it is believed that the function of the binder is to supply an adhesion force between the raw base (110) and the pigment particles, as well as binding pigment particles to each other. The binder may be selected from the group of water-soluble binders and water-dispersible polymers that exhibit high binding power for base paper stock and pigments, either alone or as a combination. Suitable polymeric binders include, but are not limited to, water-soluble polymers such as polyvinyl alcohol, starch derivatives, gelatin, cellulose derivatives, acrylamide polymers, and water-dispersible polymers such as acrylic polymers or copolymers, vinyl acetate latex, polyesters, vinylidene chloride latex, styrene-butadiene or acrylonitrile-butadiene copolymers. The polymeric binders can be polyvinylalcohol or copolymer of vinylpyrrolidone. The copolymer of vinylpyrrolidone can include various other copolymerized monomers, such as methyl acrylates, methyl methacrylate, ethyl acrylate, hydroxyethyl acrylate, hydroxyethyl methacrylate, ethylene, vinylacetates, vinylimidazole, vinylpyridine, vinylcaprolactams, methyl vinylether, maleic anhydride, vinylamides, vinylchloride, vinylidene chloride, dimethylaminoethyl methacrylate, acrylamide, methacrylamide, acrylonitrile, styrene, acrylic acid, sodium vinylsulfonate, vinylpropionate, and methyl vinylketone, etc. In some examples, the copolymer of vinylpyrrolidone can be a copolymer of vinylpyrrolidone and vinylacetate or vinylcaprolactam or polyvinylalcohol. The polyvinylalcohol or copolymer of vinylpyrrolidone can have a weight average molecular weight ranging from about 10,000 Mw to about 1,000,000 Mw or can have a weight average molecular weight ranging from about 20,000 Mw to about 500,000 Mw. In some examples, the binder is a polyvinylalcohol having a molecular length in the range of 20,000 to 500,000. The inorganic pigment and binder may be used in the following proportions or effective amounts: from 5 to 15 parts by dry weight of binder to 100 parts by dry weight of inorganic pigments. In some other examples, 8 to 10 parts binder are used relative to the 100 parts of pigment.

The pre-coating layer (120) can contain from about 5 to about 40 wt % of water-dispersible binders by total weight of the pre-coating layer and up to 10 wt % of a water-soluble binders. Examples of water-dispersible binders may include, for example, a styrene-butadiene latex such as Gencryl® 9780 or PT9619 (from Omnova Solution Inc.); an acrylic polymer sold under the trade name Raycryl® 48083 (available from Specialty Polymers); an aqueous dispersion of an n-butyl acrylate-acrylonitrile-styrene copolymer commercially available under the tradename Acronal® S 504 (available from Baden Aniline and Soda Factory (BASF)); a styrene/n-butyl acrylate copolymer Acronal® S 728 (available from Baden Aniline and Soda Factory (BASF)). In some other examples, the water-dispersible binders have a glass transition temperature (Tg) within the range of about −20° C. to about 35° C. In some other examples, the Tg of the water-dispersible binder is from −10° C. to 0° C. Examples of water-soluble binders may include, for example, a combination of polyvinyl alcohol with methanol sold under the trade name Mowiol® 6-98 (available from Kuraray America, Inc.), and 2-hydroxyethyl starch ether sold under the tradename of Penford® Gum 280 (available from Penford Products Co).

The solids content of the pre-coating composition might range from about 60 to about 75 percent by weight (wt %) with a viscosity of 1000 to 1500 centipoise (cps) as measured by a low shear Brookfield viscometer at a speed of 100 revolutions per minute (rpm), or 30 cps to 40 cps at a higher shear rate of 4500 rpm using a high shear Hercules viscometer. The pre-coating layer composition may also include any of the variety of coating additives known to improve the appearance or functionality of the media, such as, for examples, mordants, biocides, optical brightener, surfactants, plasticizers, thickener and cross-linking agents.

Top Ink-Receiving Layer (130)

The printable media (100) further includes, at least, a top ink-receiving layer (130). Said top ink-receiving layer (130) can be applied, above the pre-coating layer (120), on one side of the base substrate (as illustrated in FIG. 1), or can be applied to both sides of the base substrate (as illustrated in FIG. 2). Without being limited by any theory, it is believed that the top ink-receiving layer (130) is specifically formulated to interact with the ink in order to improve the quality of the printed image. Such top ink-receiving layer (130) can be a liquid electrophotographic printing (LEP) image-receiving layer. By liquid electrophotographic printing (LEP) image-receiving layer, it is meant herein that the layer is adapted to receive image printed image using LEP technique, such as printing device using liquid toner manufactured by Hewlett-Packard Company's Indigo press.

The top ink-receiving layer (130) includes inorganic pigments and water-dispersible polymeric binders having a glass transition temperature within the range of about 0° C. to about 35° C. The top ink-receiving layer (130) might further include non-film forming polymers as an optional ingredient. In some examples, the coat weight of the top ink-receiving layer (130) is ranging from about 5 to about 35 grams/meter$^2$ (gsm). In some other examples, the coat weight of the top ink-receiving layer (130) is ranging from about 10 to about 20 grams/meter$^2$ (gsm).

The water-dispersible polymeric binders, that are present in the top ink-receiving layer (130), have a glass transition temperature (Tg) within the range of about 0° C. to about 35° C. The glass transition temperature (Tg) of said water-dispersible polymeric binders can also be in the range of from about 10° C. to about 30° C. The way of measuring the glass transition temperature (Tg) parameter is described in, for example, Polymer Handbook, 3rd Edition, authored by J. Brandrup, edited by E. H. Immergut, Wiley-Interscience, 1989.

The water-dispersible polymeric binders can be present, in the top ink-receiving layer (130), in an amount representing from about 10% to about 30% of the total weight of the layer. Examples of such water-dispersible polymeric binders include, for example, styrene-butadiene latex such as Gencryl® 9780 (available from Omnova Solution Inc.), XU31258.50 (available from Styron Inc.) or Litex® PX 9330 (from Synthomer). Examples of suitable water-dispersible polymeric binders include also polybutadiene latex, styrene-butadiene copolymer latex, acrylonitrile-butadiene-styrene terpolymer latex, polychloroprene latex, acrylic latex, polyester emulsions, acrylonitrile-butadiene latex, polyvinyl acetate, polyvinyl acetate copolymers (e.g., vinyl acetate—ethylene latex), and combinations thereof. In some examples, the water-dispersible polymeric binder is a latex binder selected from the group consisting of polybutadiene latex, styrene-butadiene copolymer latex, acrylonitrile-butadiene-styrene terpolymer latex, polychloroprene latex, acrylic latex, polyester emulsions, acrylonitrile-butadiene latex, polyvinyl acetate and polyvinyl acetate copolymer. In some other examples, the water-dispersible polymeric binder is styrene-butadiene copolymer latex. In yet some other examples, the polymeric binder is a carboxylated styrene/butadiene copolymer.

The top-coat layer (130) may further include a water-soluble binder, as an optional ingredient, in addition to the water-dispersible polymers. Suitable water-soluble binders include, but are not limited to polymers such as polyvinyl alcohol, starch derivatives, gelatin, cellulose derivatives, and acrylamide polymers. When present, the amount of water-soluble binder is less than 10 wt % of the total weight of the layer. The water-soluble binder that is presents in the top ink-receiving layer (130) can be similar or different from the polymeric binders present in the pre-coating layer (120). In some examples, polymeric binders that are present in the top ink-receiving layer (130) and in the pre-coating layer (120) are water-dispersible binders that have a glass transition temperature (Tg) within the range of about 0° C. to about 35° C.

The top ink-receiving layer (130) includes inorganic pigments. Inorganic pigments are present in the top ink-receiving layer (130) in an amount representing from about 50% to about 90% of the total weight of the layer (130). Suitable inorganic pigments may be provided in a powder or slurry form. Examples of suitable inorganic pigments include, but are not limited to, titanium dioxide, hydrated alumina, calcium carbonate, barium sulfate, silica, clays (such as high brightness kaolin clays), zinc oxide and/or combinations thereof. Examples of inorganic pigments include, but are in no way limited to, Cartacoat® K (available from Clariant Chemical); Snowtex® ST-O, ST-OL, ST-20L, and ST-C (available from Nissan Chemical); Ludox® CL, AM and TMA (available from Grace-Davison Chemical); Nyacol® AL20, Nyacol® AL20, Nyacol® A1530, Nyacol® Ce02, Nyacol® SN15, Nyacol® DP5370, and NYACOL® Zr50/20 (available from Nyacol Nano Technologies). Examples of inorganic pigments include also GCC, sold under the tradename Hydrocarb® HG or Covercarb® HP (from Omya Inc.) or PCC sold under the tradename Opacarb® A40 (available from Specialty Minerals Inc.).

By way of example only, one suitable inorganic pigment that has desirable properties is calcium carbonate. In some examples, inorganic pigments that are present in the top ink-receiving layer (130) are calcium carbonate. The calcium carbonate may be one or more of ground calcium carbonate (GCC), precipitated calcium carbonate (PCC), modified GCC and modified PCC. In some other examples, the pigments are ground calcium carbonate (GCC) or precipitated calcium carbonate (PCC). Depending upon the distinct arrangement of the calcium, carbon, and oxygen atoms forming the calcium carbonate in the crystal structure, the calcium carbonate can assume three different crystal structures: calcite, aragonite, and/or an unstable vaterite crystal. The calcite crystal form of the calcium carbonate may assume any one of four different shapes: rhombohedral, scalenohedral, prismatic and spherical. Further, the aragonite crystal form of calcium carbonate assumes discrete or clustered needle-like shapes.

The top ink-receiving layer (130) can be formed by incorporating a calcium carbonate pigment having discrete acicular morphology and a certain aspect ratio. The aspect ratio of needle-like aragonite particles in the pigment coating may be defined as: (An=l/d) where An is the aspect ratio of needle-like particles in the pigment top coating; (l) is the average length of calcium carbonate particles and (d) is average width of the particles. In some examples, the average length of the calcium carbonate particles (l) is much greater than their average width (d). In some other examples, the aspect ratio (An) is between about 50 and about 300, or between about 70 and about 180.

The particle size of the calcium carbonate based pigments that is present in the top ink-receiving layer (130), can range from about 0.1 to about 0.8 micrometers, or from about 0.2 to about 0.5 micrometers. The inorganic pigments can have a narrow particle size distribution (PSD) where PSD=$(D_{85}/d_{15})^{1/2}$; wherein "$D_{85}$" is meant to be understood as the particle size in micrometers at which approximately 85% of the particles in the calcium carbonate based pigments by size are smaller, according to a distribution curve. Similarly, the term "$d_{15}$" is meant to be understood as the particle size in micrometers at which approximately 15% of the particles by size are smaller, according to a size distribution curve. In some examples, the inorganic pigments that are part of the top ink-receiving layer (130) have a PSD that is between about 1.2 and about 1.8. The greater PSD in the pigment coating layer will result in more abrasive and less smooth surface finish in micro-scale and reduce Indigo press blank life. The rough surface finish can be ironed in subsequent super calendaring processing through the application of a higher temperature and line pressure.

The top ink-receiving layer (130) can further include non-film forming polymers (also called herein plastic pigment). Non-film forming polymers are water dispersed, polymeric hollow spherical particles filled with water that are non-film forming in ambient conditions and that remain as discrete particles during coating. Such polymers have no substantial coalescence under manufacture and storage conditions. In more details, upon evaporation of the continuous phase (such as solvent and/or water of the dispersed solid-liquid system), the polymers are able to resist deformation and further coalescence. Said polymers can have particulate sizes ranging from about 0.3 μm to about 2 μm and/or a glass transition temperature (Tg) from about 50° C. to about 120° C. In some examples, the glass transition temperature (Tg), for these non-film forming polymers, is greater than about 70° C. Such non-film forming polymers can be present in an amount representing from about 5 to about 30 wt % by total weight of the top ink-receiving layer. The ratio between the non-filming forming polymers to pigments can be from 1:100 to 1:10. Non-film forming polymers can be chosen among the group consisting of styrene, acrylic, styrene/acrylics, vinyl/acetate, polyacrylics, methacrylates and combinations thereof. It is believed that if the particle size of the non-film forming polymers (i.e. plastic pigments) is greater than approximately 2-3 micrometer, the plastic pigment particles might help to enhance the surface smoothness and the gloss of the printable media (100). The ink-receiving layer may thus contain non-film forming polymer particles having particle sizes close to that of the needle-like aragonite particles. The size of the non-film forming polymer particles may range from about 0.2 to 0.5 microns and can be present in an amount of approximately 0.5 to 5 parts by weight based on 100 parts of inorganic pigments.

In some examples, the non-film forming polymers are polystyrene latex polymers. In some other examples, the non-film forming polymers are plastic pigment slurry of styrene/butadiene emulsion copolymers. Examples of non-film forming polymers that can be used in accordance with embodiments of the present invention include Ropaque® BC-643, Ropaque® HP-543, or Ropaque® OP-84 (all manufactured by Rohm and Haas Company, USA) and HS-3000NA or HS-3020NA (available from The Dow Chemical Company, USA). Other specific examples of these polymers may include, a styrene acrylic emulsion polymer sold under the trade name Raycat® 29033, a polyacrylic emulsion polymer sold under the trade name Raycat® 78, and an acrylic emulsion polymer sold under the trade name Raycryl® 30S available from Specialty Polymers, Inc. Other examples of such non-film forming polymers include Dow DPP™ 3720 (available from Dow Chemical). Other small amount of additives such as, for examples, slip aid, deformer, dye, OBA, pH control agent, dispersant and thickener can also be added to the top ink-receiving layer (130).

Method for Forming a Printed Article

The printable recording materials are used in printing process in view of forming printed article. In some embodiments, a method for forming printed articles (200) includes: obtaining a printable recording media (100) comprising a supporting base substrate (110) having, on both supporting sides, a pre-coating layer (120) containing inorganic pigments and polymeric binders, and having over of the pre-coating layer, at least, one top ink-receiving layer (130) containing inorganic pigments and water-dispersible polymeric binders with a glass transition temperature within the range of about 0° C. to about 35° C.; applying an ink composition on the image side of the printable media to form a printed image; and applying a post-image lamination film (220) over the printed image.

In some examples, the post-image lamination film (220) is applied only to the image side of the media. In some other examples, the post-image lamination film (220) is applied to both sides of the media. The lamination film could be applied to a printed side and to an unprinted side in view of having a better curl control, for example. In some embodiments, when the printable recording media has top ink-receiving layers (130) that are applied on both sides of the substrate (110), the ink composition could be applied to both sides of the media and the post-image lamination film (220) could also be applied to both sides of the media.

Such printing method results in printed article (200) with enhanced image quality and enhanced absorption performances. An example of the method for forming printed articles in accordance with the principles described herein, by way of illustration and not limitation, is shown in FIG. 4. FIG. 4 illustrates embodiments of the printing method that encompasses obtaining the printable recording media (100) as defined herein, applying an ink composition onto said media, applying a post-image lamination film (220) on said media and obtaining a printed article (200).

After the images are deposited, established, or printed on the printable media (100), i.e. after an ink layer (210) is formed onto the printable media, a post-image lamination film or laminate layer (220) is disposed. Such post-image lamination film (220) is deposited over the ink, or printed image, that is present on the top image receiving layer (130). In this manner, the laminate layer may provide a final photo finish such as a glossy or matte finish. Further, the laminate layer may provide image durability (such as scratch resistance) and image permanence to the media with what a consumer may consider is a true look and feel of photographic paper. The printed images, resulting from such printing technique, are photo printed image, present high image quality, a good surface smoothness and high gloss appearance.

The post-image lamination film layer (220) can be applied during the printing process (on the press during printing) or can be applied after the printing process using a hot or cold laminator. The post-image lamination film layer (220) can be made of a polyester material or of a polypropylene composition. In some examples, the laminate film (220) is a polyester material. Such polyester material includes, but is not limited to, polyethylene terephthalate (PET), glycol-modified PET, polybutylene terephthalate (PBT), polytrimethylene terephthalate (PTT), polyethylene naphthalate (PEN), polyether terephthalate, polyurethane terephthalate, or a combination or a mixture of two or more thereof. PET may be obtained from Chevron Phillips Chemical Company, The Woodlands, Tex., or from Formosa Plastics Corporation, USA, Livingston, N.J. In some examples, the lamination film is a polypropylene composition. The polypropylene composition contains homo-polymers of polypropylene (PP) and poly(ethylene vinyl acetate) (EVA), for example. Said two components can be coextruded together (i.e., 'PP and EVA'). The PP film polymer and EVA film polymer (either separate or coextruded) may be obtained from film extruder companies and casting companies including, but not limited to, Fabrene, Ontario Canada; Yidu Digital Image company, China. The lamination film is hot laminated to the image layer by a hot laminator. The typical temperature for the hot laminator is about 150° F.

The printable recording media (100), as described herein, (i.e. comprising a supporting base substrate (110) having, on both sides, a pre-coating layer (120) that contains inorganic pigments and polymeric binders, and having on, at least, one side, over of the pre-coating layer, a top ink-receiving layer (130) that includes inorganic pigments and water-dispersible polymeric binders with a glass transition temperature within the range of about 0° C. to about 35° C.) contains also a post-image lamination film (220) that is disposed over the top ink-receiving layer (210) after an ink layer is printed. Said post-image lamination (220) film could be applied on one side of the media or on both sides of the media.

The ink composition may be deposited, established, or printed on the printable media using any suitable printing device. The method for forming printed images can be done by means of digital printing technology. In some examples, the ink may be deposited, established, or otherwise printed on the printable media is a solid toner or a liquid toner. The solid toner or the liquid toner may include toner particles made, e.g., from a polymeric carrier and one or more pigments. The liquid toner may be an organic solvent-based (e.g., hydrocarbon) liquid toner. The solid toner or the liquid toner may be deposited, established, or otherwise printed on the examples of the printable media using, respectively, a suitable dry or liquid press technology, such as a dry toner electrophotographic printing device or a liquid toner electrophotographic printing device. In some other examples, the ink is a liquid electrophotographic ink (liquid toner or liquid Electrolnk) and is applied via electrophotographic printing method. Representative examples of printers used to print on the printable media, include, but are not limited to, Indigo® WS6000P Digital Printing Press or T300 Digital Web Press, both available from Hewlett-Packard Company (Palo Alto, Calif., USA).

Thus, in some embodiments, a method for forming printed articles includes obtaining a printable recording material (100) comprising a supporting base substrate (110) having, on both supporting sides, a pre-coating layer (120) that contains inorganic pigments and polymeric binders, and having, at least, on one supporting side, over of the pre-coating layer, a top ink-receiving layer (130) that includes inorganic pigments and water-dispersible polymeric binders having a glass transition temperature (Tg) within the range of about 0° C. to about 35° C.; providing a liquid electrophotographic ink; applying said ink composition on, at least, one side of the printable media, to form a printed image via electrophotographic printing method; and applying a post-image lamination film (220).

The Printed Article

The printed article (200), resulting from the printing process as described above, encompasses, thus, a printable recording media (100) with a supporting base substrate (110) having on both sides, pre-coating layers (120) containing inorganic pigments and polymeric binders; and, at least, one top ink-receiving layer (130), including inorganic pigments and water-dispersible polymeric binders having a glass transition temperature within the range of about 0° C. to about 35° C., applied over the pre-coating layer (120); a printed feature (210) applied on top of said printable recording material; and a post-print lamination layer (220) disposed above said printed image (210). The post-print lamination layer (220), or lamination film, is applied after an ink layer (210) has been printed or otherwise disposed onto the top ink-receiving layer (130) during, for example, the printing process.

Without being linked by any theory, it is believed that post-print lamination layer (220) that is applied to the printed article (200) helps to provide gloss finish, semi-gloss, luster or matte finish. The lamination film may also provide scratch resistance to the printed article. As described above, the laminate layer or post-image lamination film (220) can be made of a polyester material or of a polypropylene composition. In some examples, the post-image lamination layer (220) encompasses polyester, polypropylene (PP), PVC, nylon, and other suitable polymer film. In some other examples, the laminate film (220) is a polyester material. In yet some other examples, the post-print lamination layer (220) is a made of a BOPP (bi-axially oriented polypropylene) or of a PET (Polyethylene terephthalate) material. Such BOPP or PET materials can be available from GMP (Korea) and Yidu Digital Image Company (China).

In some embodiments, the thickness of the post-print lamination layer (220) can be in the range of from about 10 μm to 60 about μm (micrometer); or in the range of from about 25 μm to 40 about μm.

Method for Forming a Printable Recording Material

In some examples, according to the principles described herein, a method of making a printable recording media (100) with a supporting base substrate (110) having, on both sides, pre-coating layers (120), containing inorganic pigments and polymeric binders; and, at least, one top ink-receiving layer (130), including inorganic pigments and water-dispersible polymeric binders having a glass transition temperature within the range of about 0° C. to about 35° C., applied over the pre-coating layer is provided. Such method encompasses providing a supporting base substrate (110); applying pre-coating layers (120) that contains inorganic pigments a polymeric binders on both sides of the supporting base substrate; applying, over of the pre-coating layer (120), at least one top ink-receiving layer (130) that includes inorganic pigments and water-dispersible polymeric binders having a glass transition temperature (Tg) within the range of about 0° C. to about 35° C.; and drying and calendaring said pre-coating layers (120) and top ink-receiving layer (130). In some examples, the top ink-receiving layer (130) is applied on both sides of the supporting base substrate.

Such pre-coating layer (120) and top ink-receiving layer (130) can be applied using an on-machine or off-machine coater. Examples of suitable coating techniques include slotted die application, roller application, curtain coater, blade application, rod application, air knife application, gravure application, airbrush application, and others known in the arts. In some examples, the pre-coating layers (120) are coated using an offline coater, or applied during raw base paper making process. The top ink-receiving layer (130) can be applied using in line or offline coater such as blade coater, roll coater, slot, or curtain coater. The solids content of the top ink-receiving layer (130) can range from about 20 wt % to about 68 wt % depending on coating method used, with a viscosity of about 100 cps to about 2000 cps as measured by low shear Brookfield viscometer at a speed of about 100 rpm. The coat layer can then be dried by convection, conduction, infrared radiation, atmospheric exposure, or other known method.

After coating the base stock with pre-coating layer (120) and top ink-receiving layer (130), a calendaring process can be used to achieve desired gloss or surface smoothness. The calendaring device can be a separate super calendaring machine, an on-line soft nip calendaring unit, an off-line soft nip calendaring machine, or the like. Super-calendering is calendering in a calender unit in which nips are formed between a smooth-surface press roll, such as a metal roll, and a roll covered with a resilient cover, such as a polymer roll. The resilient-surface roll adapts itself to the contours of the surface of paper and presses the opposite side of paper evenly against the smooth-surface press roll. Any of a number of calendering devices and methods can be used. The calendering device can be a separate super-calendering machine, an on-line calendaring unit, an off-line soft nip calendaring machine, or the like. Some calendering systems do not require the paper to be as completely dried as other forms of calendering. In some examples, the calendering is carried out at a temperature ranging from about 50 to about 220° C. (metal roll surface temperature) and, in some other examples, from about 100 to about 170° C. The nip pressure can be any value between about 50 to about 300 Kg/cm$^2$. The roughness, of the printable recording media, after calendar process can be less than 6 μm, or less than 3 μm, per Park Print Surface method (PPS method).

EXAMPLES

Ingredients:

TABLE 1

| Ingredient name | Nature of the ingredients | supplier |
|---|---|---|
| Hydrocarb ® 60 MEZ | GCC pigment | Omya Inc. |
| Opacarb ® 3000 | PCC pigment | SMI |
| Litex ® PX 9330 | Polymer Latex (Tg of 22° C.) (carboxylated styrene/butadiene copolymer) | Synthomer |
| Gencryl PT ® 9619 | Styrene butadiene Polymer Latex (Tg of −6° C.) | Omnova Solution Inc. |
| Dow DPP ® 3720 | polystyrene latex | Dow |
| Mowiol ® 6-98 | PVOH | KSE |
| Ca-stearate | lubricant | Greven |
| Alcogum ® L265 | Thickener | Alco Chemicals |
| Sterocoll ® BL | Thickener | BASF |

Example 1—Preparation of the Media

Pre-coat layer and top ink-receiving layer formulations are prepared by mixing the ingredients as illustrated in Table 2 in view of obtaining Media A and B. The raw base is made with base paper stock prepared with cellulose fibers. Such base paper stock contains about 60% of hardwood, about 20% of softwood and about 10% of calcium carbonate fillers. The raw base is surface sized with oxidized starch. The pickup rate for the starch is 1 gsm each side. Pre-coating layers (120) and top-coating layers (130) are applied on both sides of the raw base with a coat weight of about 12 gsm with a lab blade coater at a coat weight of about is 12 gsm. The media is then calendered with a lab soft calender at 1000 psi and 100° C. The final smoothness of the recording media is about 1 micro per PPS method. The pre-coating and top-coat formulations are illustrated in the Table 2 below. Media A is a printable recording media according to the present disclosure; Media B is a comparative examples.

TABLE 2

| | MEDIA A | MEDIA B comparative |
|---|---|---|
| Base paper (110) (in wt %) | | |
| hardwood fiber | 60.0% | 60.0% |
| softwood fiber | 20.0% | 20.0% |
| calcium carbonate | 10.0% | 10.0% |
| Pre-coating layer (120) (in part per weight) | | |
| Hydrocarb ® 60 MEZ | 65 | 65 |
| Opacarb ® 3000 | 35 | 35 |
| Litex ® PX 9330- Tg of 22° C. | 9 | 9 |
| Mowiol ® 6-98 | 1 | 1 |
| Defoamer | 0.042 | 0.042 |
| Alcogum ® L261 | 0.13 | 0.13 |
| Sterocoll ® BL | 0.047 | 0.047 |
| NaOH | 0.06 | 0.06 |
| Top ink-receiving layer (130) (in part per weight) | | |
| Opacarb ® 3000 | 100 | 100 |
| Litex ® PX 9330 (Tg of 22° C.) | 9 | — |
| Gencryl PT ® 961 (Tg of −6° C.) | — | 9 |
| Dow DPP ® 3720 | 3 | 3 |
| Mowiol ® 6-98 | 1 | 1 |
| Defoamer | 0.044 | 0.044 |
| Alcogum ® L265 | 0.146 | 0.146 |
| Sterocoll ® BL | 0.017 | 0.017 |
| NaOH | 0.06 | 0.06 |

Example 2—Printable Recording Media Performances

The media A and B are printed on HP Indigo press WS6000 to check ink adhesion. A post-image lamination film is applied to both printed media with a hot lamination process (100° C.). The printed media A and B further contains a Post-image Lamination film (220) that has a coat weigh of about 29 μm. The lamination films is made of BOPP (available for GMP, Korea). The media A and B are evaluated for their printing and for their adhesion performances. The results are shown in Table 3 below.

The runnability refers to the ability of the media to run smoothly through the Indigo web press without any defects, without issues on image quality and paper break or jams. The runnability performances is evaluated during the entire duration of the printing process. The test is considered as "pass" when it is performed successfully at high speed and at default speed and amount of paper run without any media related issues.

The ink adhesion is measured by using a 3M tape. The tape is placed on the imaged sample. After the tape is pulled off the image, the OD loss is measured. The percentage of ink removal from the media is measured. Two tests are performed: "Peeling 100% ink coverage patch (CMYK) at 15 and 60 minutes (100% test patch)" and "Peeling 400% ink coverage patch (CMYK) at 15 and 60 minutes (400% test patch)". The %, in Table 3, expresses the quantity of ink that remains on the media.

The Blanket Compatibility test (i.e. Blanket memory of previous image) is evaluated. This test illustrates the ink transfer to media with acceptable ink adhesion. The interaction between the media and the blanket might cause a "Blanket Memory" effect, reflected in gloss differences between solids and background areas of the previously printed image. The test is considered as "pass" when it is performed successfully without gloss differences and background areas issues.

The "Clear Pages" test illustrates the number of the pages required for removing all materials from the blanket (more than 2 attempts is considered as a failure of the test). The "Clear Pages" test is evaluated by running two frames of yellow ink on paper in view of removing the contaminations, partial or half-done ink, transferred from the blanket.

TABLE 3

| | | MEDIA A | MEDIA B |
|---|---|---|---|
| Runnability Test | | Pass | Fail |
| Ink Adhesion | Peeling 100% | 92% | 30% |
| | Peeling 400% | 100% | 25% |
| Clear Pages Test | | 1 | 4 |
| Blanket Compatibility Test | | Pass | Fail |

The results demonstrate that comparative Media B has very poor durability performances and presents runnability issues while media A exhibits excellent durability performance and does not present any runnability issues.

The invention claimed is:

1. A printable recording media, comprising:
a supporting base substrate;
pre-coating layers, containing inorganic pigments and polymeric binders, that are applied to both sides of the supporting base substrate; and
at least one top ink-receiving layer that is applied over at least one of the pre-coating layers, the top ink-receiving layer including:
inorganic pigments;
water-dispersible polymeric binders having a glass transition temperature within the range of about 0° C. to about 35° C.; and
a non-film forming polymer having a glass transition temperature ranging from about 50° C. to about 120° C., wherein a ratio of the non-film forming polymer to the inorganic pigments ranges from 0.5:100 to 5:100.

2. The printable recording media according to claim 1 wherein the top ink-receiving layer is applied over each of the pre-coating layers.

3. The printable recording media according to claim 1 wherein the coat weight of the top ink-receiving layer is ranging from about 5 to about 35 gsm.

4. The printable recording media according to claim 1 wherein the water-dispersible polymeric binders, in the top ink-receiving layer, are present in an amount representing from about 10 wt % to about 30 wt % of the total weight of said layer.

5. The printable recording media according to claim 1 wherein the water-dispersible polymeric binders, in the top ink-receiving layer, are styrene-butadiene copolymer latex.

6. The printable recording media according to claim 1 wherein the inorganic pigments are present in the top ink-receiving layer in an amount representing from about 50% to about 90% of the total weight of said layer.

7. The printable recording media according to claim 1 wherein the coat weight of the pre-coating layer is ranging from about 2 to about 25 gsm.

8. The printable recording media according to claim 1 wherein the polymeric binders, in the pre-coating layer, are polyvinylalcohol or copolymer of vinylpyrrolidone.

9. The printable recording media according to claim 1 wherein a post-image lamination film is disposed over the top ink-receiving layer after an ink layer is printed.

10. The printable recording media according to claim 9 wherein the post-image lamination film is made of a polyester material or of a polypropylene composition.

11. A method for forming printed articles, comprising:
obtaining a printable recording media having:
a supporting base substrate;
pre-coating layers, containing inorganic pigments and polymeric binders, that are applied to both sides of the supporting base substrate; and
at least one top ink-receiving layer applied over at least one of the pre-coating layers, the top ink-receiving layer including inorganic pigments, water-dispersible polymeric binders having a glass transition temperature within the range of about 0° C. to about 35° C., and a non-film forming polymer having a glass transition temperature ranging from about 50° C. to about 120° C., wherein a ratio of the non-film forming polymer to the inorganic pigments ranges from 0.5:100 to 5:100;
applying an ink composition on at least one side of the printable media, to form a printed image on the top ink-receiving layer; and
applying a post-image lamination film over the printed image.

12. The method for forming printed articles according to claim 11 wherein the ink composition is a liquid electrophotographic ink.

13. A printed article obtained according to the method of claim 11, comprising:
the printable recording media having:
the supporting base substrate;
the pre-coating layers, containing the inorganic pigments and the polymeric binders, applied to both sides of the supporting base substrate; and the at least one top ink-receiving layer applied over at least one of the pre-coating layers, the top ink-receiving layer including the inorganic pigments, the water-dispersible polymeric binders having a glass transition temperature within the range of about 0° C. to about 35° C., and the non-film forming polymer having a glass transition temperature ranging from about 50° C. to about 120° C., wherein the ratio of the non-film forming polymer to the inorganic pigments ranges from 0.5:100 to 5:100;

the printed image applied on the top ink-receiving layer; and the post-image lamination film disposed above the printed image.

14. A method for making a printable recording material, comprising:

providing a supporting base substrate;

applying pre-coating layers containing inorganic pigments and polymeric binders on both sides of the supporting base substrate;

applying, over at least one of the pre-coating layers, at least one top ink-receiving layer that includes inorganic pigments, water-dispersible polymeric binders having a glass transition temperature within the range of about 0° C. to about 35° C., and a non-film forming polymer having a glass transition temperature ranging from about 50° C. to about 120° C., wherein a ratio of the non-film forming polymer to the inorganic pigments ranges from 0.5:100 to 5:100; and drying and calendaring said layers.

15. The printable recording media according to claim 1 wherein the water-dispersible polymeric binders are styrene butadiene polymer latex and the non-film forming polymer is polystyrene latex.

16. The printable recording media according to claim 15 wherein the ratio of the non-film forming polymer to the inorganic pigment is 3:100.

* * * * *